United States Patent [19]

Mikulas

[11] 4,182,473

[45] Jan. 8, 1980

[54] WEB TENSIONING APPARATUS

[76] Inventor: Budai Mikulas, Pelikanstrasse 5, CH-90004 St. Gallen, Switzerland

[21] Appl. No.: 884,809

[22] Filed: Mar. 9, 1978

[30] Foreign Application Priority Data

Mar. 12, 1977 [DE] Fed. Rep. of Germany ..... 2710914

[51] Int. Cl.[2] ..... B65H 17/26

[52] U.S. Cl. ..... 226/143; 226/195

[58] Field of Search ..... 226/113, 114, 143, 167, 226/195

[56] References Cited

U.S. PATENT DOCUMENTS 2,514,554 7/1950 Nowelsky ..... 226/167 X 3,110,439 11/1963 Drake ..... 226/143 X

*Primary Examiner*—Richard A. Schacher

*Attorney, Agent, or Firm*—Kenyon & Kenyon

[57] ABSTRACT

A web-tensioning apparatus has stationary and movable clamps for clamping the opposite ends of a length of web, the movable clamp having a first spring for elastically forcing it in a direction towards the length and a second spring for elastically forcing it in a direction away from the length, the second spring providing greater spring force than the first spring plus the clamped length's initial resistance to stretching. If the web does stretch a little, the first spring relaxes so that the second spring can exert more force to move the movable clamp away from the stretched length.

4 Claims, 2 Drawing Figures

WEB TENSIONING APPARATUS

BACKGROUND OF THE INVENTION

Flexible webs of at least slightly elastic material, possibly of combined such materials, are sometimes required to be pulled intermittently through a machine, such as a printing or punching machine, the web being stopped during the operation of the machine. At that time it is often required that the length of stopped web be held under a substantially uniform tension, this applying to each stop in the web's travel during which the machine is operated. For example, a paper web may be pulled through a screen printing machine and then through a punching machine, the web necessarily being stationary during each of these operations, and if the printing machine is to apply a succession of juxtapositioned prints and the following punching requires registration with these prints, for each operation the web must be stopped and held under a substantially uniform tension to insure accurate printing and punching registration.

It is possible to simply stationarily clamp the web pulled into the length to be tensioned and thus hold the web stopped against the pull required to pull the tape onward. However, when the length of web between such a stationary clamp and the length to be tensioned, is large, as when the web must be formed into loops extending from a stationary clamp to the length to be tensioned, difficulties arise. Most webs, particularly paper webs, have some elastic stretchability, and with this characteristic prevailing in the long length between the clamp and the length to be stretched, it becomes substantially impossible to assure uniform tensioning of successive lengths each time the intermittent forward movement of the tape is stopped.

The web is ordinarily pulled by being in friction engagement with an element which, when stopped, anchors the web extending backwardly, and it has been proposed to mount the clamp holding the back end of the web, in a movable fashion so that it can be pulled back a predetermined distance by suitable equipment. This has not worked well because the modulus of elasticity of the web in its various loop sections is usually unpredictable. For example, the modulus of elasticity of paper web and particularly a web of multi-ply material may have varying moduli of elasticity depending on the moisture content of the web.

SUMMARY OF THE INVENTION

The present invention is intended to provide for substantially uniformly tensioning successively the desired lengths of an intermittently pulled web, during its stationary periods, even though the modulus of elasticity of the web may vary unpredictably and even though that length must be tensioned via an extensive length of the web as in the case when the web loops over a number of rollers before reaching the length to be tensioned.

According to the present invention, the above is achieved by using stationary and movable clamp means for clamping the opposite ends of the length to be tensioned, the movable clamp means having a first spring means for elastically forcing it in a direction towards the clamped length, and a second spring means for elastically forcing it in a direction away from that length. This second spring means is designed to provide greater spring force than the first means plus the clamp length's resistance to stretching. The clamps may clamp the tensioned length via an extensive length of the web as previously indicated.

In the conventional way the clamp means may be held open while the web moves forwardly and clamp on the web each time the web stops. The spring means are arranged so that the first spring means, which urges the movable clamp means towards the length to be tensioned, is always in effect, so that the two clamp means, when actuated, clamp a fixed length of web between them, including the length to be tensioned. The second spring means is provided with equipment for causing its actuation only after the clamp means have clamped on the web and with this second spring means having adequate strength it provides an elastic force greater than or overcoming the spring force of the first means plus any elastic stretch resistance the web might have. In this way the length to be tensioned, possibly reached through many loops of web between that length and one or the other of the two clamp means, is held stretched under tension.

The above tension is applied substantially uniformly to the successive lengths which must be tensioned for each stoppage of the web travel, because if the stretched web elastically extends somewhat, the tension of the first spring means normally elastically forcing the movable clamp towards the tensioned length, relaxes or becomes less strained, so that the force it exerts forwardly on the movable clamp means, diminshes. At the same time the second spring means, now freed from some of the counterforce of the first spring means, can increase the force it exerts for moving the movable clamp away from the tensioned length. By proper design of the springs and any mechanical parts incidentally required for their connection with the movable clamp means, it is possible to provide a balancing condition so that the tensioned length is successively uniformly tensioned each time the intermittently pulled web stops and the clamping means are operated. Preferably means are provided for adjusting the elastic force of at least the first spring means, and all mechanical parts involved in connection with the movable clamp means, should be designed to be as free from friction restraints as it is possible to do.

BRIEF DESCRIPTION OF THE DRAWINGS

The principles of the present invention are schematically illustrated by the accompanying drawings in which.

DETAILED DESCRIPTION OF THE INVENTION

Figure 1:
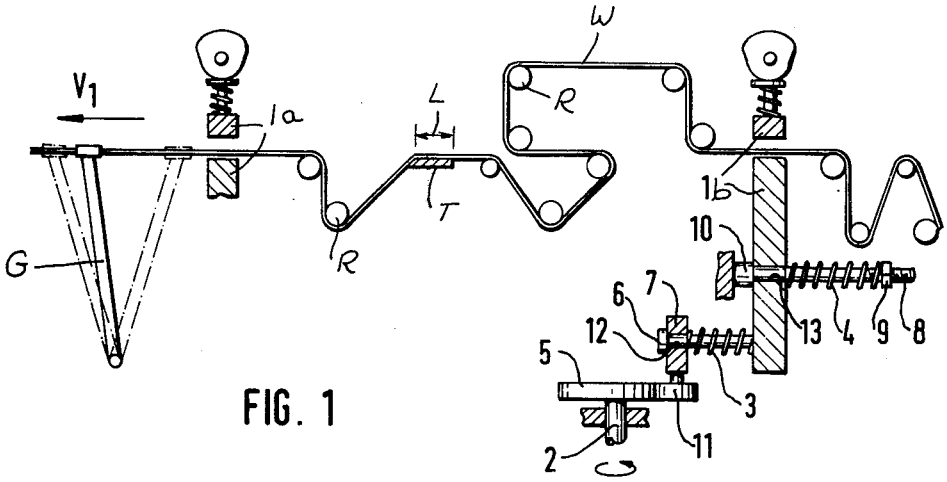
FIG. 1 is a side elevation of an example of the new machine, as the parts appear while the web is travelling forwardly.

In FIG. 1 the web W is shown as being looped over a relatively large number of rollers R and pulled by a reciprocating gripping mechanism G which in FIG. 1 is pulling the web W over a table T where the web length L on top of this table is to be operated on. For example, the table T may be the printing table of a screen printing machine where, while the web is stationary each time, a screen print is made on the web to form a succession of prints which may be juxtaposed. The Length L must be held tensioned for such printing, and if the length varies in extent due to varying tension, the prints may either overlap or be undesirably interspaced.

Figure 2:
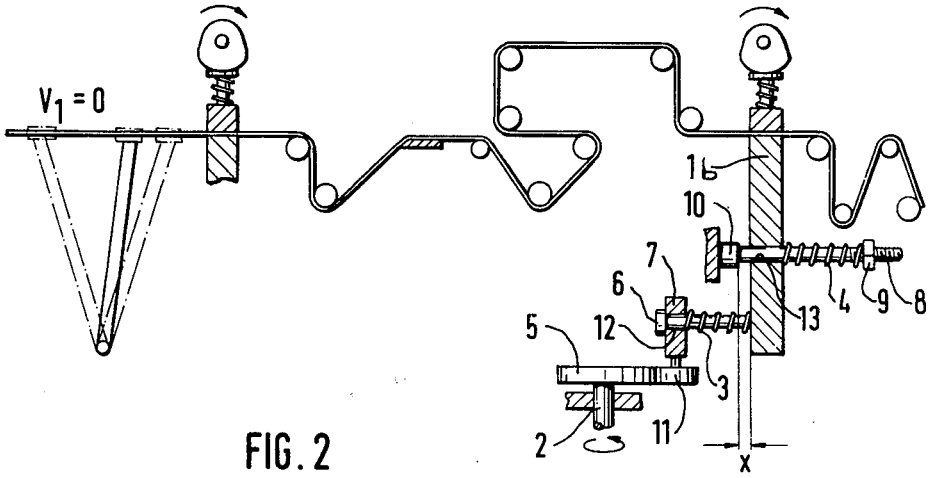
FIG. 2 is the same as FIG. 1 excepting that it shows the action occurring when the web travel is momentarily halted, the clamping means are engaged, and the momentarily stopped length is tensioned.

In FIG. 2 the stationary clamp 1*a* and the movable clamp 1*b* have both clamped on the web, it being understood that both may be of the normal cam-actuated type which clamp the web as the oscillating gripper G is returning to make another advance stroke, the web then being stationary. When the movable clamp 1*b* clamps, it has been moved to a forward position by a compression coil spring 4 mounted on a bar 8 and held compressed by an adjustable nut 9 screwed on this bar 8 against that end of the spring, the other end of the spring bearing against the front of an extension of the movable clamp 1*b* and the bar slidably passing through that extension, as at 13, the rod having a forward end that is immovably anchored as at 10.

In other words, the clamp 1*b* is normally elastically biased to a forward position by this first spring means 4.

A second spring means is provided by a compression coil spring 3 having one end engaging the back of the extension of the movable clamp 1*b*, and an opposite end engaging an abutment 7 which is backwardly movable in a backward moving direction of the clamp 1*b*. This spring 3 is positioned by a rod 12 which slidingly passes through the abutment 7 and has a head 6 on its outer end to prevent the abutment 7 from being forced off of the rod 12 by the spring 3. This abutment is movable by a roller cam follower 11 which rides on a rotary cam 5 turned by a shaft 6. By possibly conventional means not shown, this shaft 2 is rotated for an appropriate turn each time, but only after the clamps go into operation, the abutment 7 then being elastically pushed backwardly so that via the spring 3 the movable clamp 1*c* is pushed backwardly at least slightly as, for example, as indicated by the arrow X.

Now the length L is held under a substantially uniform tension. If its length and the length of the web running from the clamp 1*a* backwardly to the length L and from there backwardly to the clamp 1*b*, should elastically stretch slightly, the spring 3 elastically pushes the movable clamp 1*b* backwardly against the counterforce of the spring 4 and the stretching resistance of the web; if the web elastically stretches less than expected, the spring 3 is compressed so that its backward force on the movable clamp increases, but this is counteracted by the counterforce of the spring 4.

By proper spring designing and adjustment of the nut 9, the movable clamp 1*b*, in effect, floats back and forth depending on the modulus of elasticity of the web W throughout the range of movement indicated at X, while always maintaining a substantially uniform tension on the web W between the two clamps and, therefore, on the length L where the screen printing or other operations are being performed.

What is claimed is:

1. An apparatus for tensioning a length of elastic web, comprising stationary and movable clamp means for clamping the opposite ends of said length, the movable clamp means having a first spring means for elastically forcing it in a direction towards said length and a second spring means for elastically forcing the movable means in a direction away from said length, said second means providing greater spring force than said first means plus said length's resistance to stretching.

2. The apparatus of claim 1 in which said web intermittently moves forwardly and said length is clamped intermittently by said clamp means when the web is stationary, and said second spring means has means for causing its actuation only after said movable clamp means clamps said length.

3. The apparatus of claim 2 in which at least one of said spring means has means for controlling the degree of its said elastic forcing.

4. The apparatus of claim 3 in which said web between said length and at least one of said clamp means, extends for a substantial distance in the form of loops.

* * * * *